US008593352B2

(12) United States Patent
Tseng et al.

(10) Patent No.: US 8,593,352 B2
(45) Date of Patent: Nov. 26, 2013

(54) TRIPLE-BAND ANTENNA WITH LOW PROFILE

(75) Inventors: Hsien-Sheng Tseng, Tu-Cheng (TW); Shang-Jen Chen, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 617 days.

(21) Appl. No.: 12/857,764

(22) Filed: Aug. 17, 2010

(65) Prior Publication Data

US 2011/0037672 A1 Feb. 17, 2011

(30) Foreign Application Priority Data

Aug. 17, 2009 (TW) ..... 98127534

(51) Int. Cl.
*H01Q 1/24* (2006.01)
*H01Q 13/10* (2006.01)
*H01Q 1/48* (2006.01)

(52) U.S. Cl.
USPC ..... 343/702; 343/767; 343/846

(58) Field of Classification Search
USPC ..... 343/700 MS, 702, 767, 846, 848
See application file for complete search history.

(56) References Cited

U.S. PATENT DOCUMENTS

| | | | | |
|---|---|---|---|---|
| 7,501,987 | B2 | 3/2009 | Wang et al. | |
| 7,777,684 | B2 * | 8/2010 | Rao et al. | 343/770 |
| 7,782,261 | B2 * | 8/2010 | An et al. | 343/702 |
| 2006/0262016 | A1 | 11/2006 | Hung et al. | |
| 2007/0103367 | A1 * | 5/2007 | Wang | 343/700 MS |
| 2009/0073052 | A1 | 3/2009 | Hung et al. | |
| 2010/0238072 | A1 * | 9/2010 | Ayatollahi et al. | 343/700 MS |

FOREIGN PATENT DOCUMENTS

| | | |
|---|---|---|
| CN | 2706884 Y | 6/2005 |
| CN | 101102008 | 1/2008 |
| CN | 101308954 | 11/2008 |

* cited by examiner

*Primary Examiner* — Michael C Wimer
*Assistant Examiner* — Hasan Islam
(74) *Attorney, Agent, or Firm* — Wei Te Chung; Ming Chieh Chang

(57) ABSTRACT

A multi-band antenna includes a grounding element having an edge and a grounding point, a first radiating arm being substantially of L shape and located above the grounding element, a second radiating arm working at a first frequency band and being substantially of L shape above the first radiating arm, a third radiating arm working at a second frequency band and being substantially of rectangular metal patch parallel to the edge of the grounding element, and a feeding line including an inner conductor connected to the first radiating arm and an outer conductor connected to the grounding point of the grounding element. The feeding line, the first radiating arm, the grounding element commonly compose a slot operating at a third frequency band.

20 Claims, 3 Drawing Sheets

TRIPLE-BAND ANTENNA WITH LOW PROFILE

BACKGROUND OF THE INVENTION

1. Field of the Invention

The present invention relates generally to a triple-band antenna, and more particularly to a low-profile triple-band antenna used in an electronic device.

2. Description of the Prior Art

In recent years, for adapting for development of wireless net, antennas are required to own low profile, multi frequency bands for being easily assembled in electronic devices. U.S. Pat. No. 7,501,987 issued to Chih-Ming Wang et al. on Mar. 10, 2009, discloses a triple-band antenna which comprising a first radiating element, a second radiating element and a feeding line. The first radiating element comprises a first metal patch working at a higher frequency band, a second metal patch and a third metal patch commonly working at a lower frequency band. The second radiating element comprises a fourth metal patch, fifth metal patch and a sixth metal patch commonly working at a middle frequency band. However, the triple-band antenna is of complex structure, big volume and not adapt for present electronic device.

Hence, in this art, a low-profile antenna used for multi bands so as to overcome the above-mentioned disadvantages of the prior art should be provided.

BRIEF SUMMARY OF THE INVENTION

A primary object, therefore, of the present invention is to provide a multi-band antenna with compact structure.

In order to implement the above object, the multi-band antenna comprises a grounding element having an edge and a grounding point, a first radiating arm being substantially of L shape and located above the grounding element, a second radiating arm working at a first frequency band and being substantially of L shape above the first radiating arm, a third radiating arm working at a second frequency band and being substantially of rectangular metal patch parallel to the edge of the grounding element, and a feeding line comprising an inner conductor connected to the first radiating arm and an outer conductor connected to the grounding point of the grounding element. The feeding line, the first radiating arm, the grounding element commonly compose a slot operating at a third frequency band.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment made in accordance with the present invention.

Figure 1:
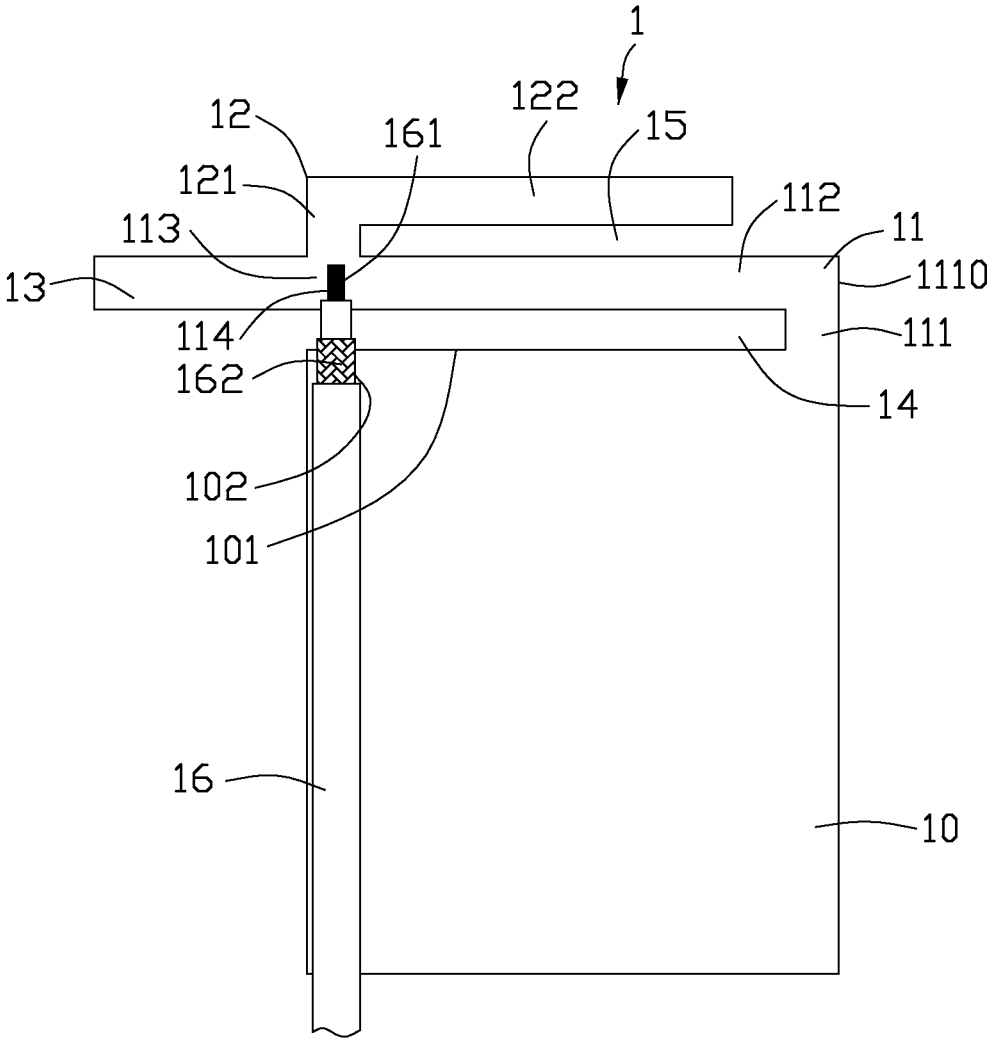
FIG. 1 is a perspective view illustrating a preferred embodiment of a multi-band antenna made in accordance with the present invention.
Figure 2:
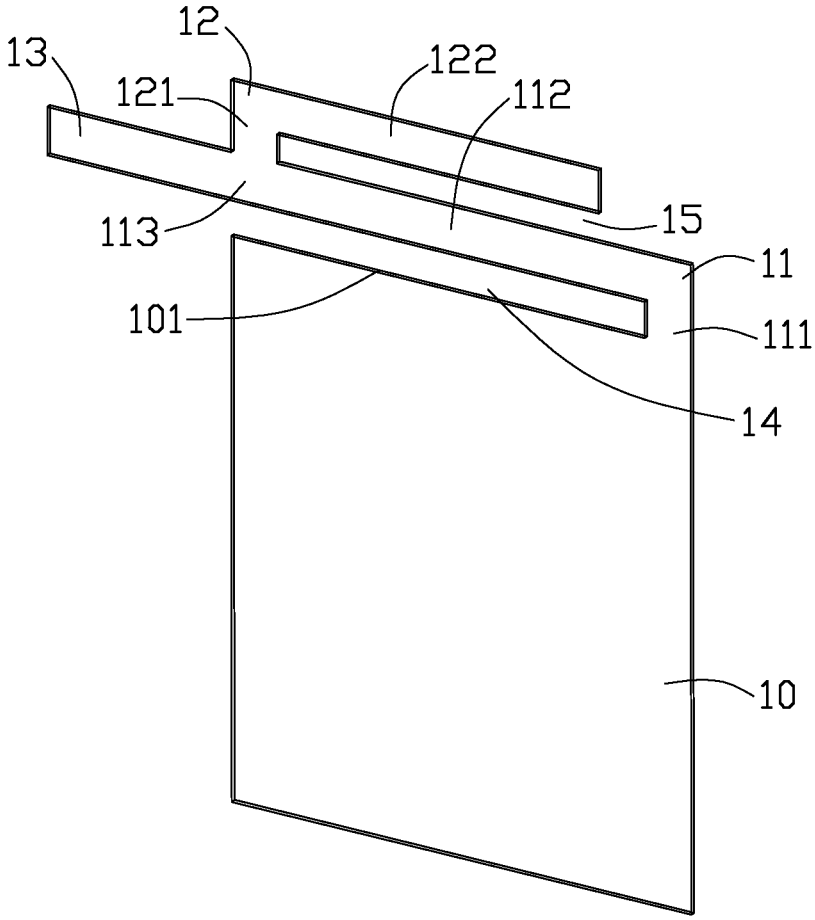
FIG. 2 is a perspective view of the antenna shown in FIG. 1 without a feeding line, but viewed from another angle.

Reference to FIGS. 1 and 2, a multi-band antenna 1 made in accordance with a preferred embodiment of the present invention is shown. The multi-band antenna 1 comprises a grounding element 10, a first radiating arm 11, a second radiating arm 12, a third radiating arm 13 and a feeding line 16.

The grounding element 10 is of big rectangular metal patch, and has a first edge 101 and a grounding point 102. The first radiating arm 11 is of L shape and upward extends from the first edge 101 of the grounding element 10. The radiating arm 11 comprises a first side 111 perpendicularly connected to a right end of the first edge 101, and a second side 112, extending from the end of the first side along a first direction parallel to the first edge 101 to form an end 113 opposite to an end 1110 of the first side 111. The second radiating arm 12 is located above the first radiating arm 11 and of an L-shape metal patch. The second radiating arm 12 comprises a first side 121 upward extending from the end 113 of the first radiating arm 11 and a second side 122 extending from the end of the first side 121 along a second direction parallel to the first edge 101 but opposite to the first direction. The third radiating arm 13 extends from the end 113 of the first radiating arm 11 and is arranged in the same line with the first radiating arm 11. The second side 112 of the first radiating arm 11, the first side 121 of the second radiating arm 12 and the third radiating arm 13 are connected together to the end 113. A feeding point 114 is formed on the end 113 and in other embodiment, the feeding point 114 can move on the first radiating arm 11. The feeding line 16 comprises an inner conductor connected to the feeding point 114 and an outer conductor connected to the grounding point 102. The feeding line 16, the first radiating arm 11, and the grounding element 10 compose a first slot 14. A second slot 15 is formed between the second side 112 of the first radiating arm 11 and the second radiating arm 12.

The antenna is made by cutting a single metal patch, or incising a printed circuit board or a flexible printed circuit, or plating an insulation board.

Figure 3:
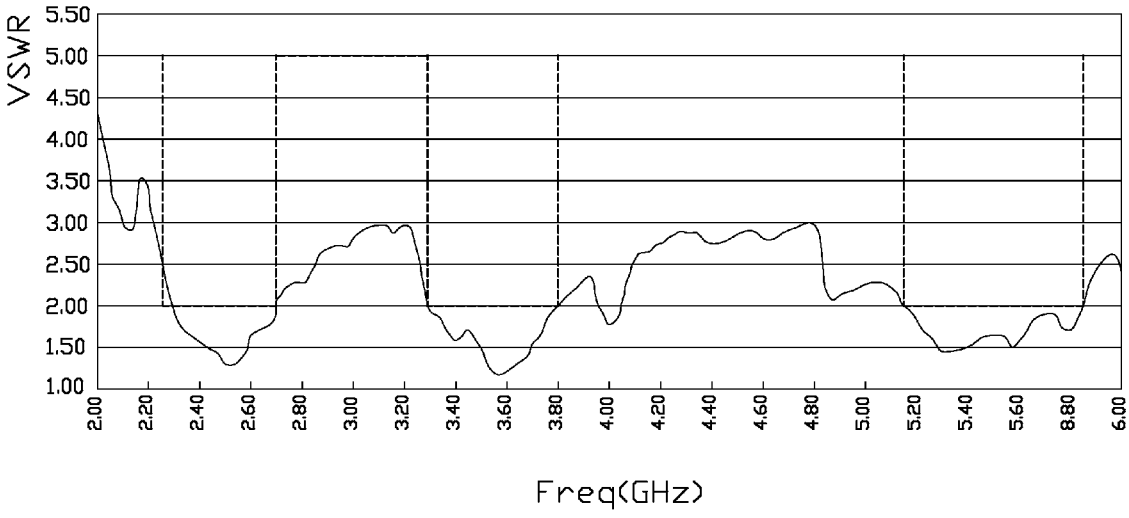
FIG. 3 is a test chart record of the first antenna of the multi-band antenna made in accordance with present invention, showing Voltage Standing Wave Ratio (VSWR).

Referring to FIG. 3, the antenna 1 of this invention works on three frequency bands every two of which are different from each other. The second radiating arm 12 operates at a first frequency band on 2.3-2.7 GHz and the length of the second radiating arm 12 is substantially equal to a quarter of the wavelength of the center frequency of the first frequency band. The third radiating arm 13 operates on a second frequency band on 3.3-3.8 GHz and the length of the third radiating arm 13 is substantially equal to a quarter of the wavelength of the center frequency of the second frequency band. The first slot 14 works on a third frequency band on 5.15-5.85 GHz and the perimeter of the first slot 14 is substantially equal to a half of the wavelength of the center frequency of the third frequency band. In other embodiment, the three frequency bands can be adjusted by changing the length of the second radiating arm 12, the third radiating arm 13 or the position of the feeding point 114.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element having an edge and a grounding point;

a first radiating arm being substantially of L shape and located above the grounding element;

a second radiating arm working at a first frequency band and being substantially of L shape above the first radiating arm;

a third radiating arm working at a second frequency band and being substantially of rectangular metal patch parallel to the edge of the grounding element;

a feeding line comprising an inner conductor connected to the first radiating arm and an outer conductor connected to the grounding point of the grounding element; wherein the feeding line, the first radiating arm, the grounding element commonly compose a slot operating at a third frequency band; wherein said third radiating arm is arranged in the same line with the first radiating arm and has a same width with the first radiating arm.

2. The multi-band antenna as claimed in claim 1, wherein every two of said first, second and third frequency band are different from each other.

3. The multi-band antenna as claimed in claim 1, wherein said first radiating arm comprises a first side perpendicularly connected to an end of the first edge of the grounding element, and a second side extending from an end of the first side along a first direction parallel to the first edge to form an end opposite to the end of the first side.

4. The multi-band antenna as claimed in claim 3, wherein said second radiating arm comprises a first side upward extending from the end of the second side of the first radiating arm and a second side extending from the end of the first side along a second direction parallel to the first edge but opposite to the first direction.

5. The multi-band antenna as claimed in claim 4, wherein said third radiating arm extends from the end of the second side of the first radiating arm, said second side of the first radiating arm, the first side of the second radiating arm and the third radiating arm are connected together to the end.

6. The multi-band antenna as claimed in claim 1, wherein the length of the second radiating arm is approximately equal to a quarter of the wavelength of the center frequency of the first frequency band.

7. The multi-band antenna as claimed in claim 1, wherein the length of the third radiating arm is approximately equal to a quarter of the wavelength of the center frequency of the second frequency band.

8. The multi-band antenna as claimed in claim 1, wherein the perimeter of the first slot is approximately equal to a half of the wavelength of the center frequency of the third frequency band.

9. The multi-band antenna as claimed in claim 1, wherein said multi-band antenna is made by incising a printed circuit board or a flexible printed circuit, or plating an insulation board.

10. A multi-band antenna, comprising:

a grounding element having a grounding point;

a first radiating arm having a first end connected to the grounding element and further having a feeding point;

a second radiating arm separated from the grounding element and connected to a second end of the first radiating arm opposite to the first end;

a third radiating arm separated from the grounding element and connected to the second end of the first radiating arm;

a feeding line comprising an inner conductor connected to the feeding point and an outer conductor connected to the grounding point; wherein said feeding line, the first radiating arm, and the grounding element compose a slot operating on a frequency band; wherein said third radiating arm is arranged in the same line with the first radiating arm, the first radiating arm, the second radiating arm and the third radiating arm are arranged in a same plane.

11. The multi-band antenna as claimed in claim 10, wherein said third radiating arm has a same width with the first radiation arm.

12. The multi-band antenna as claimed in claim 10, wherein said second radiating arm operates on a first frequency band, the third radiating arm operates on a second frequency band and the slot operates on a third frequency band.

13. The multi-band antenna as claimed in claim 12, wherein every two of said three frequency bands are different from each other.

14. The multi-band antenna as claimed in claim 10, wherein said first radiating arm comprises a first side perpendicularly connected to an end of the first edge of the grounding element, and a second side extending from an end of the first side along a first direction parallel to the first edge to form an end opposite to the end of the first side.

15. The multi-band antenna as claimed in claim 14, wherein said second radiating arm comprises a first side upward extending from the end of the second side of the first radiating arm and a second side extending from the end of the first side along a second direction parallel to the first edge but opposite to the first direction.

16. The multi-band antenna as claimed in claim 15, wherein the first side of the second radiating arm and the third radiating arm are connected together to the end.

17. A multi-band antenna comprising:

a grounding element;

a first radiating arm connected to the grounding element and including a first horizontal L-shaped configuration to define a first slot with the grounding element under condition that said first slot faces to an exterior in a first horizontal direction;

a second radiating arm upwardly connected to the first radiating arm and including a second horizontal L-shaped configuration to define a second slot with the first radiating arm under condition that said second slot faces to the exterior in a second horizontal direction opposite to the first horizontal direction;

a third radiating arm horizontally connected to the first radiating arm and extending along said first horizontal direction; and a feeding line including an inner conductor connected to a first position shared by all the first radiating arm, the second radiating arm and the third radiating arm, and an outer conductor connected to a second position on the grounding element;

said first horizontal L-shaped configuration including a first horizontal side and a first vertical side, and said second horizontal L-shaped configuration including a second horizontal side and a second vertical side; wherein the first horizontal side is dimensioned and configured to be aligned with the first horizontal side in the first horizontal direction, and the second vertical side is aligned with a line defined by said first position and said second position in a vertical direction perpendicular to both said first horizontal direction and said second horizontal direction.

18. The multi-band antenna as claimed in claim 17, wherein said feeding line essentially blocks passage of said first horizontal slot from the exterior.

19. The multi-band antenna as claimed in claim 17, wherein the said first position and said second position are essentially aligned with a side boundary of the grounding element in a vertical direction.

20. The multi-band antenna as claimed in claim 19, wherein said first radiating arm is connected to the grounding element at another position which is essentially aligned with another side boundary of the grounding element in the vertical direction, said another side boundary is opposite to the side boundary in a parallel relation.

* * * * *